US008281637B2

(12) United States Patent
Sheriff

(10) Patent No.: US 8,281,637 B2
(45) Date of Patent: Oct. 9, 2012

(54) FORMING TOOLS AND ASSOCIATED METHODS

(75) Inventor: Timothy W. Sheriff, Duluth, MN (US)

(73) Assignee: Swanstrom Tools USA Inc., Duluth, MN (US)

( * ) Notice: Subject to any disclaimer, the term of this patent is extended or adjusted under 35 U.S.C. 154(b) by 64 days.

(21) Appl. No.: 12/858,042

(22) Filed: Aug. 17, 2010

(65) Prior Publication Data

US 2011/0041583 A1 Feb. 24, 2011

Related U.S. Application Data

(60) Provisional application No. 61/235,501, filed on Aug. 20, 2009.

(51) Int. Cl.
*B25B 25/00* (2006.01)

(52) U.S. Cl. ..... 72/409.13

(58) Field of Classification Search ..... 72/409.01, 72/409.04, 409.06, 409.08, 409.11, 409.13, 72/409.14, 406.16, 409.17; 140/102.5, 123, 140/123.5

See application file for complete search history.

(56) References Cited

U.S. PATENT DOCUMENTS

| | | | | |
|---|---|---|---|---|
| 649,955 | A | 5/1900 | Ronk | |
| 1,337,616 | A | 4/1920 | Olhovsky | |
| 1,353,847 | A | 9/1920 | Parker | |
| 1,483,497 | A | 2/1924 | Whitfield | |
| 2,398,209 | A | 4/1946 | Clemens | |
| 2,456,532 | A * | 12/1948 | Perazzo | 72/412 |
| 2,606,471 | A | 4/1952 | Kollweck | |
| 2,824,583 | A | 2/1958 | Knoester | |
| 2,854,874 | A | 10/1958 | Decker | |
| 2,857,792 | A | 10/1958 | Mcnish | |
| 3,174,517 | A | 3/1965 | Wilson | |
| 3,360,018 | A | 12/1967 | Lindsay | |
| 3,374,808 | A | 3/1968 | Schroeder | |
| 3,847,189 | A | 11/1974 | Guzda | |
| 3,861,430 | A | 1/1975 | Story | |
| 4,043,364 | A | 8/1977 | Rose | |
| 4,221,118 | A | 9/1980 | Chicckine | |
| 4,423,757 | A | 1/1984 | Broberg, Jr. | |
| 4,637,084 | A | 1/1987 | Wood | |
| 5,277,231 | A | 1/1994 | Dostalek | |
| 5,520,227 | A | 5/1996 | Kelley | |
| 5,630,345 | A | 5/1997 | Ciccotelli | |
| 5,632,086 | A | 5/1997 | Helwig | |
| 5,878,788 | A | 3/1999 | Gurry | |
| 5,987,752 | A | 11/1999 | Swanstrom, Jr. | |
| 6,009,583 | A | 1/2000 | Swanstrom, Jr. | |
| 6,108,878 | A | 8/2000 | Adell | |
| 6,386,076 | B1 | 5/2002 | Swanstrom, Jr. | |
| 6,408,724 | B1 | 6/2002 | Whiteford | |

(Continued)

OTHER PUBLICATIONS

Easy Ear Wire Jig/ Jewelry Making Supplies—Beading Supplies / Hand Tools, www.contenti.com, Mar. 31, 2006, 1 page.

(Continued)

*Primary Examiner* — Faye Francis
(74) *Attorney, Agent, or Firm* — Faegre Baker Daniels LLP

(57) ABSTRACT

Provided are tools, tool kits, and associated methods for forming and/or clasping needs associated with, for example, jewelry making activities. The tools herein releasably secure forming pegs and restrain lateral movement of the forming pegs to a first line of action. The tools also translate an actuation force along a second line of action to relative lateral movement of the forming pegs along the first line of action.

19 Claims, 14 Drawing Sheets

U.S. PATENT DOCUMENTS

| | | | |
|---|---|---|---|
| 6,612,206 | B1 | 9/2003 | Heggemann et al. |
| 6,658,971 | B2 | 12/2003 | Delbrugge, Jr. et al. |
| 6,662,690 | B1 | 12/2003 | Ploeger |
| 6,694,841 | B2 | 2/2004 | Kesinger |
| 6,708,588 | B2 | 3/2004 | Kesinger et al. |
| 6,721,983 | B2 | 4/2004 | Dallas et al. |
| 6,748,830 | B1 | 6/2004 | Swanstrom, Jr. |
| 6,862,962 | B1 | 3/2005 | Delbrugge, Jr. et al. |
| 6,941,844 | B2 | 9/2005 | Hile |
| 6,973,859 | B2 | 12/2005 | Noniewicz |
| 7,032,627 | B1 | 4/2006 | Sheriff |
| 7,073,367 | B1 | 7/2006 | Aldridge |
| 7,343,939 | B1 | 3/2008 | Sheriff |
| 7,814,817 | B1 | 10/2010 | Sheriff |
| 2011/0041583 | A1 | 2/2011 | Sheriff |
| 2012/0000326 | A1 | 1/2012 | Sheriff |

OTHER PUBLICATIONS

EZ Earring, Make your own custom ear wires the EZ Earring way, www.bosbeads.com, Mar. 31, 2006, 4 pages.

How to Make Basic Wire Earrings, www.eHow.com, Mar. 31, 2006, 3 pages.

Parallel-action pliers, Rio Grande publication, www.riogrande.com, pp. 19-21.

Unsolicited Materials Provided to T. Sheriff by W. Fretz on or about Feb. 2010.

* cited by examiner

FORMING TOOLS AND ASSOCIATED METHODS

CROSS REFERENCE TO RELATED APPLICATION

This application claims the benefit under 35 U.S.C. §119 of U.S. Provisional Application No. 61/235,501, filed on Aug. 20, 2009, entitled "Hand Tools and Associated Methods," which is incorporated herein by reference in its entirety for all purposes.

BACKGROUND

Various types of workpiece forming tools, including grasping tools, have been proposed. For example, U.S. Pat. No. 5,632,086 to Helwig describes a wire bending jig kit for making attachments used in jewelry making. The kit includes a plate with four pins positioned on the plate in a cross pattern. Jewelry wire is bent around the pins in a specific sequence to produce various types of articles, such as clasps and coils used in the making of jewelry. The kit also contains a bar having an aperture near one end used by itself and with the plate to form connectors.

SUMMARY

Some aspects relate to a tool extending from a proximal end to a distal end. The tool includes an actuation portion adapted to generate a forming force along a first line of action; a drive portion secured to the actuation portion; and a mounting portion including a first mounting arm and a second mounting arm. The second mounting arm is secured to the drive portion to receive the forming force through the drive portion such that the forming force is translated along a second line of action. A first perforation plate having at least one first peg aperture is secured to the first mounting arm. A second perforation plate has at least one second peg aperture and is secured to the second mounting arm, relative to the first perforation plate such that upon the actuation portion generating a forming force the second plate moves along the second line of action. In some aspects, at least one first peg is releasably received in the at least one first peg aperture and at least one second peg is releasably received in the at least one second peg aperture.

In some embodiments, the tool includes a first handle having a proximal end and a distal end. A first perforation plate is optionally connected to the first handle at a first pivot located near the distal end of the first handle, the first perforation plate having a first upper surface and at least one first peg aperture formed into the first upper surface. In some embodiments, a first forming peg is releasably received in the at least one first peg aperture and extends from the upper surface. A second handle is optionally connected to the first handle at a handle pivot, the handle pivot being located proximal of the first jaw pivot. Additionally, a second perforation plate is connected to the second handle at a second jaw pivot located near the distal end of the second handle as desired, the first perforation plate optionally having a second upper surface and at least one second peg aperture and the handle pivot being located proximal of the second jaw pivot. In some embodiments, a second forming peg is releasably received in the at one second peg aperture and extends from the upper surface. The first and second perforation plates optionally have a first and second plurality of peg apertures, respectively. In some embodiments, a plurality of forming pegs are received in the first and second plurality of peg apertures. The peg apertures are optionally formed by an end user, the first and second perforation plates being formed of a plastic material, for example.

In some embodiments, the first and second pegs extend substantially parallel to one another. If desired, the first perforation plate is formed of a metallic material. The first perforation plate is optionally formed of a polymeric material. In some embodiments, the first and second perforation plates are connected by a first slider such that the first and second perforation plates are moved substantially parallel to one another along a substantially straight line of action. Moreover, in some embodiments, the first and second perforation plates are further connected by a second slider extending substantially parallel to the first slider. The first slider optionally extends through the first and second perforation plates. In some embodiments, the handle pivot is adapted such that actuation of the first and second handles toward one another results in actuation of the first and second perforation plates away from one another. In other embodiments, the first and second perforation plates move toward one another as proximal portions of the first and second handles are moved toward one another. In some embodiments, each of the first and second perforation plates has a plurality of forming pegs received in each of the first and second pluralities of peg apertures, respectively.

In some embodiments, the forming tool actuation portion includes a linear actuator, the drive portion includes an elongate drive arm, and the mounting portion includes a base to which the actuator and the first mounting arm are secured. In some embodiments, the linear actuator includes at least one of a pneumatic drive, a screw drive, a hydraulic drive, or a rack and gear drive.

In some embodiments, the actuation portion includes a threaded rod and the drive portion includes at least one of a handle crank, an electric motor, or a rack and gear powered by an air cylinder or hydraulic cylinder.

In some embodiments, the actuation portion includes a rack, the drive portion includes a gear. The drive portion optionally includes at least one of an electric motor or a rack and gear powered by an air cylinder or hydraulic cylinder.

In some embodiments, the first perforation plate is secured to the drive portion to receive the forming force through the drive portion such that the forming force is translated along a second line of action. In some embodiments, the second perforation plate is secured to the actuation portion and being secured relative to the first perforation plate such that upon the actuation portion generating a forming force the second plate moves along the second line of action. In some embodiments, the forming tool includes a form designed with a geometric shape secured to the actuation portion and a retention peg secured to the actuation portion. In some embodiments, the actuation portion includes at least one of a one-way bearing or ratchet mechanism.

Other aspects relate to a forming kit including a tool, first and second perforation plates, and first and second forming pegs. The tool extends from a proximal end to a distal end, and includes a first handle and a second handle. The first handle has a proximal end and a distal end with a first receptacle optionally located proximate the distal end of the first handle. In some embodiments, the second handle also has a proximal end and a distal end with a second receptacle located proximate the distal end of the first handle. If desired, the second handle is connected to the first handle at a handle pivot, the handle pivot being located proximal of the first and second receptacles. In some embodiments, the first perforation plate includes a first connector and a first receptacle portion having a first upper surface and at least one peg aperture formed into the first upper surface. The first connector is optionally adapted to pivotably secure the first perforation plate to the first handle at the first receptacle. In some embodiments, the first forming peg is adapted to be releasably received in the first receptacle and to be releasably received in one of the at least one first peg aperture and the second perforation plate includes a second connector and a second receptacle portion having a second upper surface and at least one second peg aperture formed into the second upper surface, the second connector being adapted to pivotably secure the second perforation plate to the second handle at the second receptacle. The second forming peg is optionally adapted to be releasably received in the second receptacle and to be releasably received in the at least one second peg aperture.

In some embodiments, the forming kit further includes a plurality of forming peg pairs of different sizes and shapes, each pair being adapted to be received in the peg apertures of the first and second pluralities of peg apertures, respectively. The plurality of forming peg pairs optionally graduate in diameter. If desired, the plurality of forming peg pairs include a pair of offset forming pegs, each of the offset forming pegs having an upper portion and a lower portion, the upper portion defining an upper central longitudinal axis and the lower portion defining a lower central longitudinal axis that is offset from the upper central longitudinal axis.

Still other aspects relate to a forming kit including a tool and a plurality of forming peg pairs. In some embodiments, the tool extends from a proximal end to a distal end and includes a first handle and a second handle. The first handle optionally has a proximal end and a distal end, the first handle having a first receptacle proximate the distal end of the first handle. In some embodiments, the second handle has a proximal end and a distal end, the second handle having a second receptacle proximate the distal end of the second handle and being connected to the first handle at a handle pivot. The handle pivot is optionally located proximal of the first and second receptacles. In some embodiments, the plurality of forming peg pairs include a first forming peg adapted to be received in the first receptacle and a second forming peg adapted to be received in the second receptacle, where each of the plurality of forming peg pairs differs in configuration.

In some embodiments, the first handle comprises a first set screw extending into the first aperture for securing one of the forming pegs in the first aperture and the second handle comprises a second set screw extending into the second aperture for securing one of the forming pegs in the second aperture.

Still other aspects relate to a method of manipulating a workpiece. In some embodiments, the method includes releasably securing at least one first forming peg into at least one first receptacle formed into a first perforation plate connected to a first mounting portion of a forming tool. At least one second forming peg is optionally releasably secured in at least one second receptacle formed into a second perforation plate connected to a second mounting portion of the forming tool, the second mounting portion being connected to an actuation portion via a drive portion, and the first and second mounting portions being slidably secured relative to one another to move along a first line of action. The workpiece is engaged as desired with the at least one first and second forming pegs by generating a forming force with the actuation portion along a second line of action to cause the first and second mounting portions to move along the first line of action.

In some embodiments, the work piece is a piece of wire that is connected end-to-end and the method further comprises deforming the piece of wire by moving the at least one first and second forming pegs away from one another. If desired, engaging the workpiece with the at least one first and second forming pegs includes moving the first and second perforation plates along a substantially straight line of action relative to one another.

This summary is not meant to be limiting in nature. While multiple embodiments are disclosed herein, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
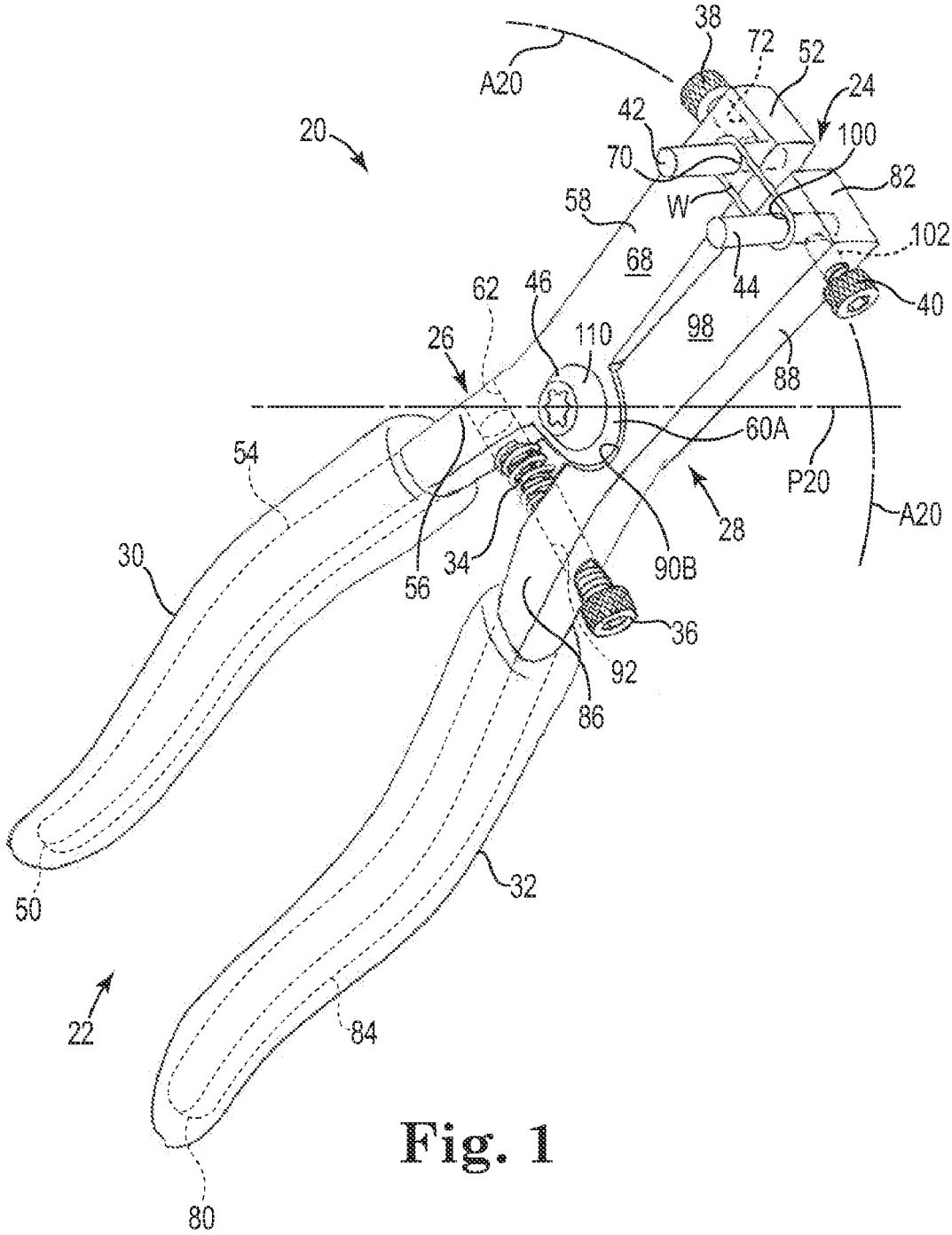
FIG. 1 is a perspective view of a tool in an open state, according to some embodiments.

Various embodiments have been shown by way of example in the drawings and are described in detail below. As stated above, the intention, however, is not to limit the invention by providing such examples.

DETAILED DESCRIPTION

In general terms, various embodiments relate to tools, tool kits, and associated methods. The tools herein comprise a means for releasably securing one or more first forming pegs and one or more second forming pegs in a substantially vertical position. In some embodiments, the tools include first and second handles having receptacles that provide means for releasably securing forming pegs in a substantially vertical position. In some embodiments, the tools includes first and second perforation plates, the perforation plates providing means for releasably securing forming pegs in a substantially vertical position. Each of the perforation plates optionally has upper surfaces with at least one receptacle formed therein. At least one forming peg is releasably received in the receptacles and handles or other actuators are operated to move the perforation plates. In some embodiments, mounting arms maintain first and second perforation plates.

In some embodiments, the perforation plates move along a substantially straight line of action with respect to one another, the perforation plates being able to move toward and away from one another in a parallel relationship. The forming tools provided herein include means for restraining lateral movement of the one or more first forming pegs and one or more second forming pegs to a first, substantially straight, line of action.

The forming tools herein include a means for translating an actuation force along a line of action. Means for translating an actuating force include a drive portion of a handle or a drive arm, for example.

The perforation plates provide versatile solutions to forming and/or clasping needs associated with, for example, jewelry making activities. These and other additional or alternate features according to various embodiments are treated in the following detailed description with reference to the accompanying figures.

FIG. 1 is a perspective view of a tool 20, according to some embodiments. As shown, the tool 20 has a proximal end 22 and a distal end 24 and is adapted to pivot about a handle pivot P20, also described as an axis of rotation P20, where the tool 20 optionally defines a substantially curved first line of action A20 at the distal end 24. In some embodiments, the tool 20 includes a first handle 26, a second handle 28, a first grip cover 30, a second grip cover 32, a biasing member 34, a limiter 36, a first retainer 38, a second retainer 40, a first forming peg 42, a second forming peg 44, and a fastener 46.

The first handle 26 extends from a proximal end 50 to a distal end 52, where a proximal portion 54 (also described as an actuation portion or actuation arm), an intermediate portion 56 (also described as a drive portion or drive arm), and a distal portion 58 (also described as mounting portion or mounting arm) are defined along the length of the first handle 26. The first handle 26 is formed of an appropriate material (e.g., high chromium, high carbon alloy steel).

The proximal portion 54 is adapted to receive the first grip cover 30 and generally serves as a location for a user (not shown) to grasp the tool 20. Thus, various additional or alternate ergonomic features are incorporated into the proximal portion 54 as desired.

Figure 3:
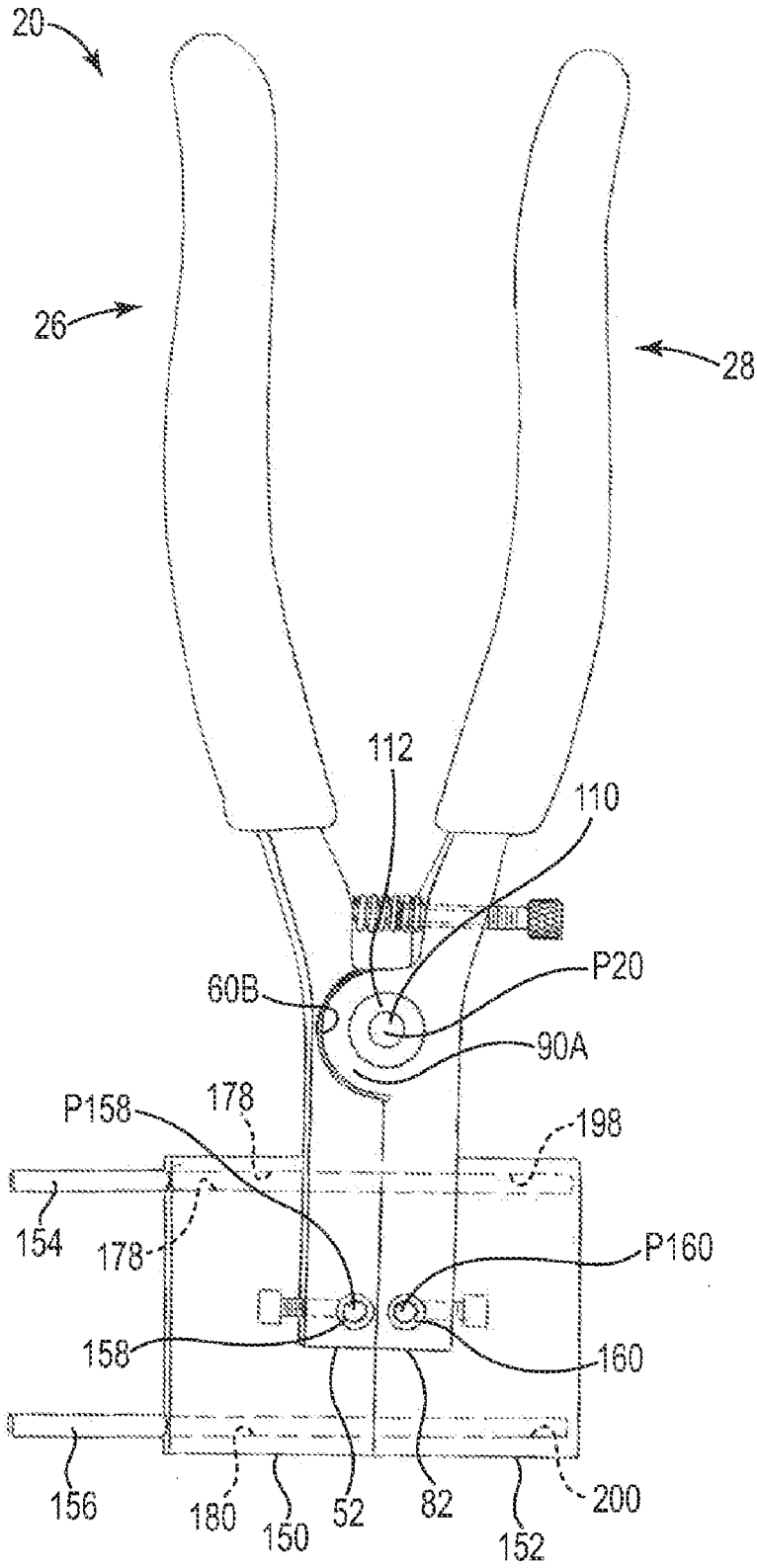
FIG. 3 is a bottom view of the tool of FIG. 2 in a closed state, according to some embodiments.

In some embodiments, the intermediate portion 56 forms a first pivot boss 60A having an aperture (not shown) for receiving the fastener 46 and a first pivot seat 60B (FIG. 3). As subsequently described, the intermediate portion 56 is suited for mating with the second handle 28 in a complementary fit. The intermediate portion 56 also optionally has a first biasing member seat 62 for securing the biasing member 34. The first biasing member seat 62 optionally extends partially or entirely through the intermediate portion 56 as desired.

The distal portion 58 has an upper surface 68 and a first receptacle 70, also described as a peg aperture, extending from the upper surface 68 downward through the first handle 26. As shown, the first receptacle 70 extends substantially perpendicular to the first line of action A20 of the tool 20. The first receptacle 70 also extends substantially parallel to the aperture in the first pivot boss 60A, which is also substantially parallel to the axis of rotation P20 of the tool 20. The distal portion 58 also includes a retainer aperture 72 for receiving the first retainer 38. The retainer aperture 72 is in communication with, or opens into the first receptacle 70, the retainer aperture 72 extending substantially perpendicular to the first receptacle 70. In some embodiments, the retainer aperture 72 includes female threads (not shown).

The second handle 28 similarly extends from a proximal end 80 to a distal end 82, where a proximal portion 84 (also described as an actuation portion or actuation arm), an intermediate portion 86 (also described as a drive portion or drive arm), and a distal portion 88 (also described as a mounting portion or mounting arm) are defined along the length of the second handle 28. The second handle 28 is formed of an appropriate material (e.g., high chromium, high carbon alloy steel).

The proximal portion 84 is adapted to receive the second grip cover 32 and generally serves as a location for a user (not shown) to grasp the tool 20 in coordination with the proximal portion 54 of the first handle 26. Thus, various additional or alternate ergonomic features are also incorporated into the proximal portion 84 as desired.

The intermediate portion 86 forms a second pivot boss 90A (FIG. 3) having an aperture (not shown) receiving the fastener 46 and a second pivot seat 90B. The second pivot seat 90B is adapted to mate with the first pivot boss 60A of the first handle 26 in a substantially complementary fit. In turn, the second pivot boss 90A is adapted to mate with the first pivot seat 60B in a substantially complementary fit. The apertures through the first and second pivot bosses 60A, 60B align to define the handle pivot P20, or axis of rotation P20 of the tool 20. As shown, the pivot bosses and seats 60A, 60B, 90A, 90B optionally define curved profiles (e.g., to encourage smooth pivoting between the first and second handles 26, 28). The intermediate portion 86 also includes a second biasing member seat 92 for securing the biasing member 34. The second biasing member seat 92 optionally extends partially or entirely through the intermediate portion 86 as desired. In some embodiments, the second biasing member seat 92 includes female threading and is adapted to receive the limiter 36 as shown.

The distal portion 88 has an upper surface 98 and a second receptacle 100, also described as a peg aperture, extending into the upper surface 98 downward through the second handle 28. As shown, and similarly to the first receptacle 70, the second receptacle 100 extends substantially perpendicular to the line of action A20 of the tool 20. The second receptacle 100 also extends substantially parallel to the apertures in the pivot bosses 60A, 90A, which are also substantially parallel to the axis of rotation P20 of the tool 20. The distal portion 88 also includes a retainer aperture 102 for receiving the second retainer 40. The retainer aperture 102 is in communication with, or opens into the second receptacle 100, the retainer aperture 102 extending substantially perpendicular to the first receptacle 100. In some embodiments, the retainer aperture 102 includes female threads (not shown).

The first and second grip covers 30, 32 are optionally substantially similar, being formed, for example, of foamed-material grips sold under the trade mark "SOFT TOUCH" by Swanstrom Tools, Inc. A variety of suitable materials and methods of forming are contemplated in association with the first and second grip covers 30, 32.

The biasing member 34 is optionally a helical spring extending between the intermediate portions 56, 86. In other embodiments, the biasing member 34 includes two, stainless steel, double-action adjustable leaf springs that are welded in place to the intermediate portions 56, 58, respectively. A variety of other biasing members are also contemplated.

The limiter 36 is optionally a bolt-type fastener that is adjustable within the second biasing member seat 92. For example, the limiter 36 is optionally adjustable to protrude a desired extent into the space between the first and second intermediate portions 56, 86 to limit the proximity to which the intermediate portions 56, 86 are able to be actuated. A variety of other limiting mechanisms are also contemplated.

The first and second retainers 38, 40 are optionally substantially similar. In some embodiments the first and second retainers 38, 40 are bolt-type fasteners (e.g., internal hex head bolts) that are adjustably threaded into the retainer apertures 72, 102, respectively. In some embodiments, the first and second retainers 38, 40 are screwed into the retainer apertures 72, 102, respectively, sufficiently to retain the first and second forming pegs 42, 44 in the first and second receptacles 70, 100.

The first and second forming pegs 42, 44 are optionally substantially similar. In some embodiments, the first and second forming pegs 42, 44 are steel rods, cylindrical in cross-section and having a diameter of about ⅛ inches, for example. As subsequently described, a variety of diameters are contemplated, lending to the interchangeability and versatility of the tool 20.

The fastener 46 optionally includes a bolt portion 110 and a nut portion 112 (FIG. 3). The bolt portion 110 is received in the aperture in the pivot boss 60A and the nut portion 112 is received in the aperture in the pivot boss 90A, the bolt portion 110 and nut portion 112 fitting and being secured together in a nut-and-bolt arrangement.

In some embodiments, assembly of the tool 20 as shown in FIG. 1 proceeds as follows. The first and second handles 26, 28 are arranged with the pivot bosses and seats 60A, 90A, 60B, 90B in a complementary fit. The fastener 46 is used to secure the handles 26, 28 together in a pivoting arrangement about the axis of rotation P20. The biasing member 34 is secured in the biasing member seats 62, 92 (e.g., press fit) and the limiter 36 is threaded into the biasing member seat 92 a desired extent to control the amount of travel, or relative rotation between the handles 26, 28. The first and second forming pegs 42, 44 are inserted into the first and second receptacles 70, 100. The first and second retainers 38, 40 are threaded into the retainer apertures 72, 102, respectively to secure the first and second forming pegs 42, 44 into the first and second receptacles 70, 100, respectively.

In some methods of forming a workpiece W, the workpiece is slipped over the forming pegs 42, 44. The proximal portions 54, 84 of the handles 26, 28 are moved toward one another to move the distal ends 52, 82 away from one another in a stretching movement, thus moving the forming pegs 42, 44 away from one another along the first line of action A20 of the tool 20. The workpiece W is optionally a loop of wire, a loop of flat metal, or other material that is stretched and formed to the first and second forming pegs 42, 44 during the stretching movement, or outward spacing of the distal ends 52, 82 along the line of action A20. Although some embodiments include a stretching movement, as subsequently described, in some other embodiment tools, actuation of the handles thereof results in a clamping movement.

Figure 2:
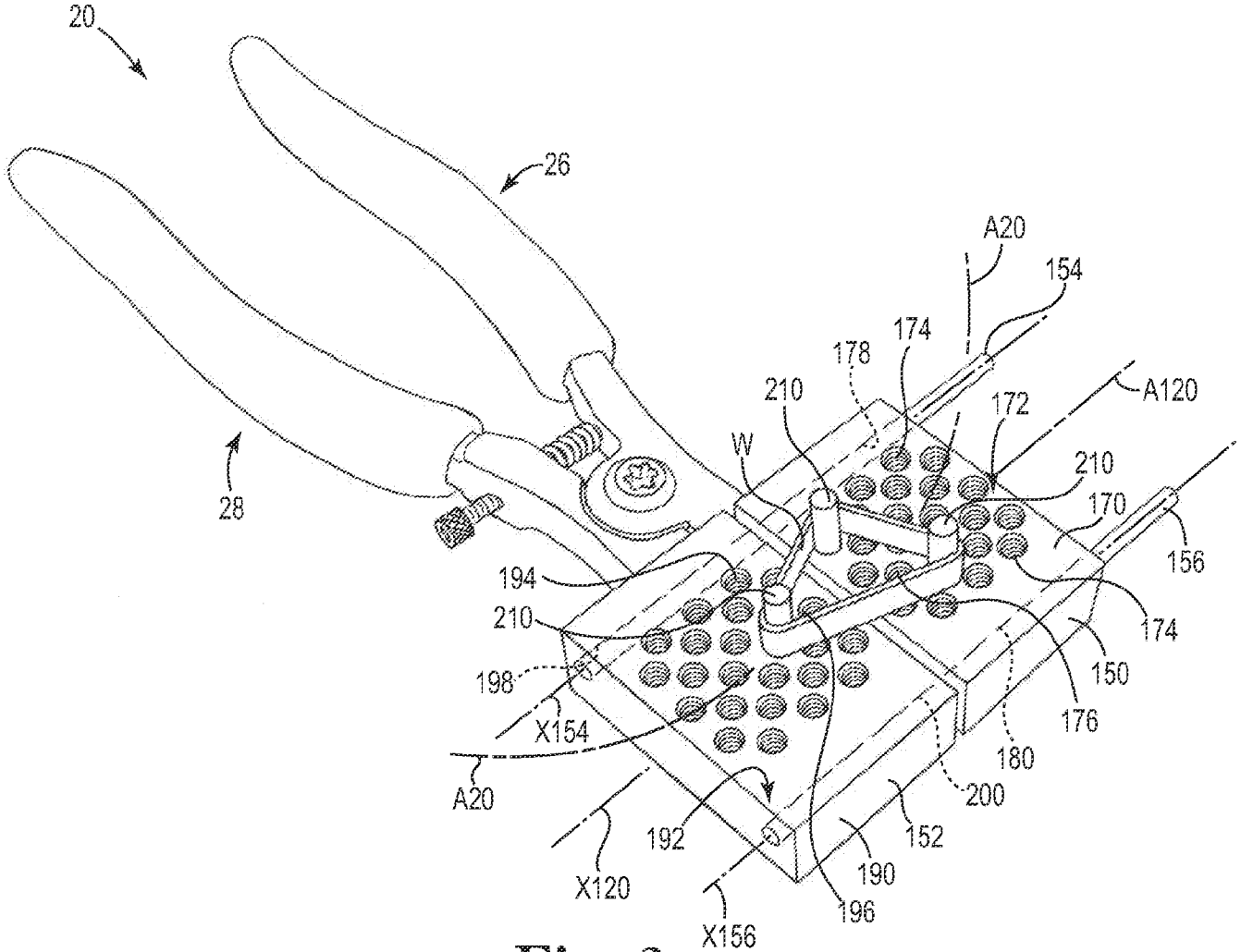
FIG. 2 is a perspective view of another tool in a open state, according to some embodiments.

FIGS. 2 and 3 show the tool 20 with accessories that are pre-assembled to the handles 26, 28 or are provided with the tool 20 as a kit of parts. As shown in FIG. 2, the accessories include a first perforation plate 150, a second perforation plate 152, a first slider 154, a second slider 156, a first pivot fastener 158 (FIG. 3), and a second pivot fastener 160 (FIG. 3).

In some embodiments, the first perforation plate 150 includes a body 170 that is substantially block- or plate-shaped and having an upper surface 172. The body 170 has a first plurality of receptacles 174, also described as peg apertures, and a first pivot receptacle 176 formed into the upper surface 172. The body 170 also has a first slider lumen 178 and a second slider lumen 180 for receiving the first and second sliders 154, 156, respectively.

Each of the plurality of receptacles 174 is optionally of a similar diameter to the first and second receptacles 70, 100. Such an arrangement adds versatility, as forming pegs are able to be interchangeably arranged directly in the handles 26, 28 or in the first perforation plate 150 as desired. In some embodiments, the first plurality of receptacles 174 is only partially formed into the first perforation plate 150 (rather than through the first perforation plate 150) to help avoid use of additional retaining mechanisms with the first perforation plate 150. The first plurality of receptacles 174 optionally extend substantially perpendicular to the upper surface 172 and/or substantially parallel to the first and second receptacles 70, 100 upon assembly of the first perforation plate 150 to the first handle 26.

The first pivot receptacle 176 optionally passes through the body 170 and includes female threading adapted to mate with the first pivot fastener 158 (FIG. 3). As subsequently described, the first pivot fastener 158 is optionally passed through the first receptacle 70 of the first handle 26 and threaded into the first pivot receptacle 176 to pivotably secure the first perforation plate 150 to the first handle 26.

The first perforation plate 150 is optionally formed of metal or polymeric material. In some embodiments, the first perforation plate 150 is provided without the first plurality of receptacles 174. In particular, in some embodiments the end user (not shown) is able to drill or otherwise form holes into the first perforation plate 150 as desired. For example, the first perforation plate 150 is optionally formed of a material that is amenable to machining by an end user (e.g., appropriate polymeric material, such as those sold under the trade name "DELRIN").

The first and second slider lumens 178, 180 are optionally substantially similar, extending substantially parallel to one another through the body 170 under the upper surface 172.

In some embodiments, the second perforation plate 152 includes a body 190 that is substantially block- or plate-shaped and has an upper surface 192. The body 190 has a second plurality of receptacles 194, also described as peg apertures, and a second pivot receptacle 196 formed into the upper surface 192. The body 190 also has a first slider lumen 198 and a second slider lumen 200 for receiving the first and second sliders 154, 156, respectively.

Each of the plurality of receptacles 194 is optionally of a similar diameter to the first and second receptacles 70, 100. Such an arrangement adds versatility, as the forming pegs are able to be interchangeably arranged directly in the handles 26, 28, the first perforation plate 150, or in the second perforation plate 152 as desired. In some embodiments, the second plurality of receptacles 194 is only partially formed into the body 190 (rather than through the body 190) to help avoid use of additional retaining mechanisms. The second plurality of receptacles 194 optionally extend substantially perpendicular to the upper surface 192 and/or substantially parallel to the first and second receptacles 70, 100 upon assembly of the second perforation plate 152 to the second handle 28.

The second pivot receptacle 196 optionally passes through the body 190 and includes female threading adapted to mate with the second pivot fastener 160 (FIG. 3). As subsequently described, the second pivot fastener 160 is optionally passed through the second receptacle 100 of the second handle 28 and threaded into the second pivot receptacle 196 to pivotably secure the second perforation plate 152 to the second handle 28.

Similarly to the first perforation plate 150, the second perforation plate 152 is optionally formed of metal or polymeric material. In some embodiments, the second perforation plate 152 is provided to an end user (not shown), for example in a kit of parts, without the second plurality of receptacles 194. In particular, in some embodiments the end user (not shown) is able to drill or otherwise form holes into the second perforation plate 152 as desired. In some embodiments, the second perforation plate 152 is formed of a material that is amenable to machining by an end user (e.g., appropriate polymeric material, such as those sold under the trade name "DELRIN").

The first and second slider lumens 198, 200 are optionally substantially similar, extending substantially parallel to one another through the body 190 under the upper surface 192.

The first and second sliders 154, 156 are optionally substantially similar. In some embodiments, the first and second sliders 154, 156 are formed of a cylindrical rod material (e.g., steel stock material). In some embodiments, the first slider 154 is adapted to be received in the first slider lumens 178, 198 and the second slider 156 is adapted to be received in the second slider lumens 180, 200, as subsequently described. Each of the first and second sliders 154, 156 defines a central longitudinal axis X154, X156, respectively.

As shown in FIG. 3, the first and second pivot fasteners 158, 160 are optionally bolt-type fasteners (e.g., internal hex head bolts) first pivot fastener 158, and a second pivot fastener 160. The first and second pivot fasteners 158, 160 are adapted to be secured in the first and second pivot receptacles 176, 196 (FIG. 2), respectively.

In view of the foregoing, and as shown in FIGS. 2 and 3, some methods of assembling the tool 20 further include aligning the first pivot receptacle 176 of the first perforation plate 150 to the first receptacle 70 in the first handle 26 and securing the first pivot fastener 158 through the first receptacle 70 and into the first pivot receptacle 176 to define a first jaw pivot P158 about which the first perforation plate 150 pivots. The first jaw pivot P158 is located distal the handle pivot P20 according to some embodiments. In some embodiments, the first and second sliders 154, 156 are press fit or otherwise secured into the first and second slider lumens 198, 200 in the second perforation plate 152 such that the first and second sliders 154, 156 are secured to the second perforation plate 152 and extend outwardly therefrom. The first perforation plate 150 is slid onto the first and second sliders 154, 156—the first and second sliders 150, 152 being slidably received in the first and second slider lumens 178, 180.

In some embodiments, the second perforation plate 152 is aligned to the second handle 28, and in particular the second pivot receptacle 196 of the second perforation plate 152 to the second receptacle 90 in the second handle 28 and securing the second pivot fastener 158 through the second receptacle and into the second pivot receptacle 196 to define a second jaw pivot P160 about which the second perforation plate 152 pivots. The second jaw pivot P160 is located distal the handle pivot P20 according to some embodiments. Upon assembly, the first and second perforation plates 150, 152 are pivotably secured to the first and second handles 26, 28, respectively. Additionally, the first and second perforation plates 150, 152 are slidably connected to one another via the first and second sliders 156, 158.

The distal portions 58, 88 of the first and second handles 26, 28 help provide means for restraining the relative lateral movement of the forming pegs to a first line of action. In some cases the means for restraining the relative lateral movement of the forming pegs to a substantially straight line of action includes the first and second sliders 156, 158.

Upon actuation of the proximal portions 54, 84 of the first and second handles 26, 28 the distal ends 52, 82 move along the substantially curved first line of action A20 (FIG. 2) while the first and second perforation plates 150, 152 of the tool 20 move along a substantially straight second line of action A120 (FIG. 2). The second line of action A120 is generally parallel to the first and second sliders 154, 156 and in particular the central longitudinal axes X154, X156 of the first and second sliders 154, 156. For reference, FIG. 2 shows the tool 20 in a partially open state after moving the proximal portions 54, 84 of the first and second handles 26, 28 toward one another where FIG. 3 shows the tool 20 in a fully closed state prior to moving the proximal portions 54, 84 of the first and second handles 26, 28 toward one another.

In some methods of forming a workpiece (FIG. 2), the workpiece W is slipped over a plurality of forming pegs 210, which are each optionally substantially similar to the forming pegs 42, 44. In particular, the plurality of forming pegs 210 are arranged as desired as an array in the first and second perforation plates 150, 152, respectively. The proximal portions 54, 84 of the handles 26, 28 are actuated toward one another to produce a forming force that moves the distal ends 52, 82 (FIG. 3) away from one another in a stretching movement, and thus to move the perforation plates 150, 152 and forming pegs 210 away from one another along the substantially straight second line of action A120. As shown, the workpiece W is formed to the array formed by the plurality of forming pegs 210. Although the workpiece W is optionally a loop of wire as shown in FIG. 1, FIG. 2 shows the workpiece W as a loop of flat metal.

Figure 4:
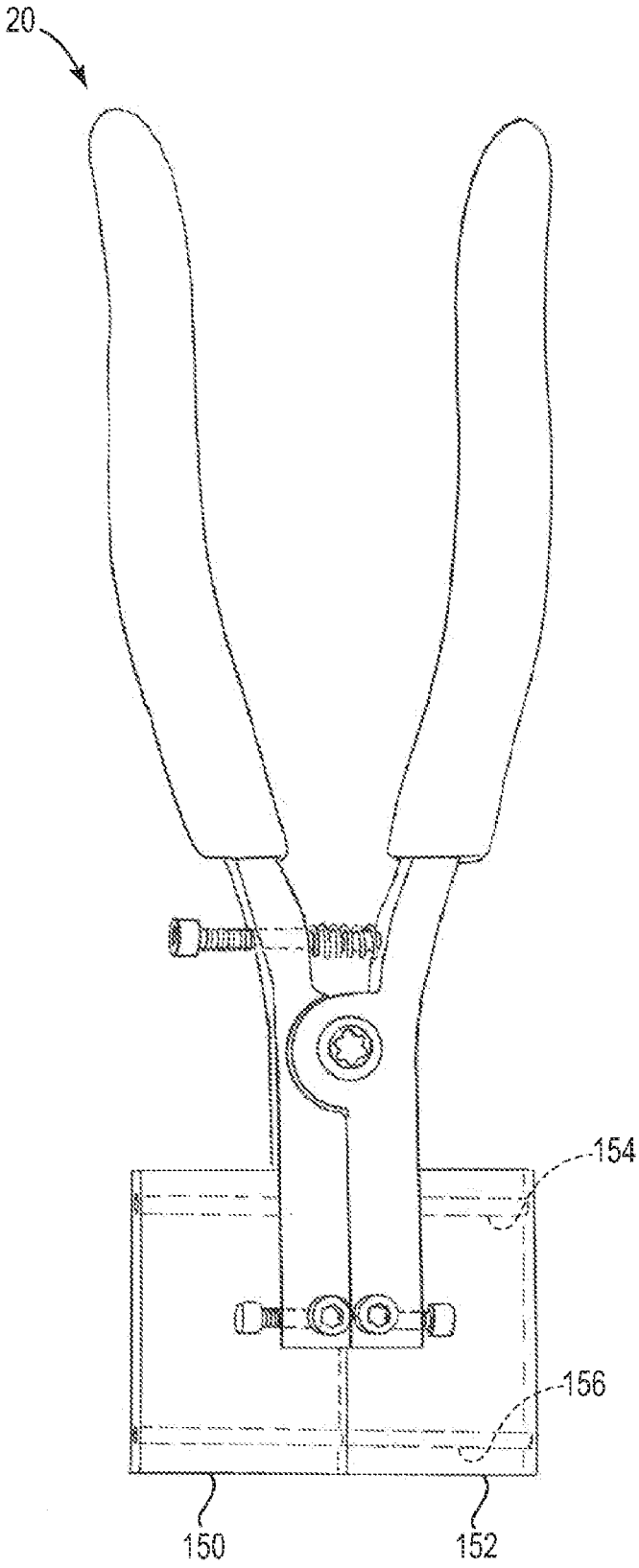
FIG. 4 is a bottom view of another tool having another slider configuration, according to some embodiments.
Figure 5:
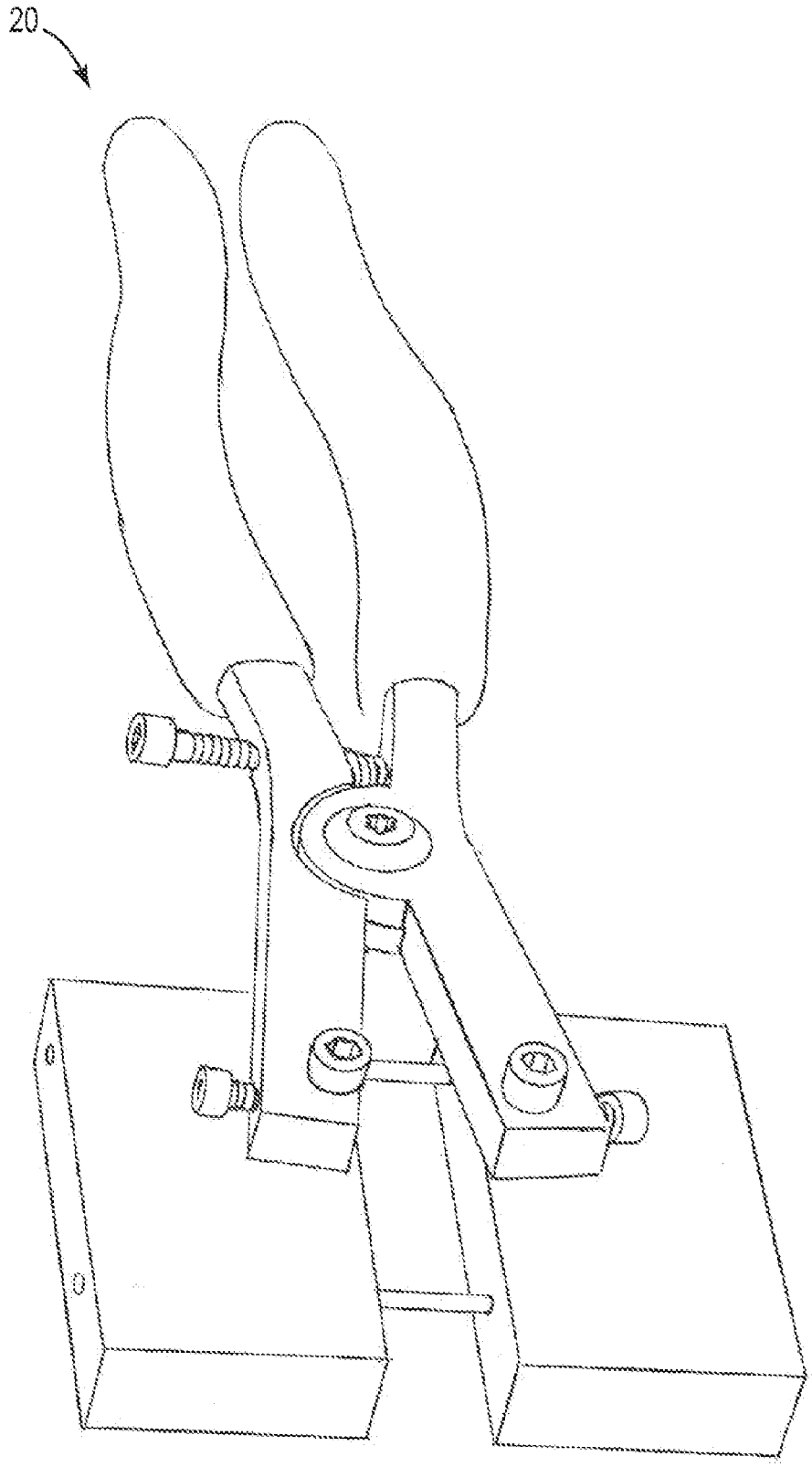
FIG. 5 is a perspective view of the tool of FIG. 2 in an open state.

As shown in FIG. 3, in some embodiments, the first and second sliders 154, 156 generally protrude from the second perforation plate 152 when the tool 20 is in the closed state. In other embodiments, as shown in FIG. 4, the first and second sliders 154, 156 are sized to reside within the first and second perforation plates 150, 152 when the tool 20 is in the closed state.

Figure 6:
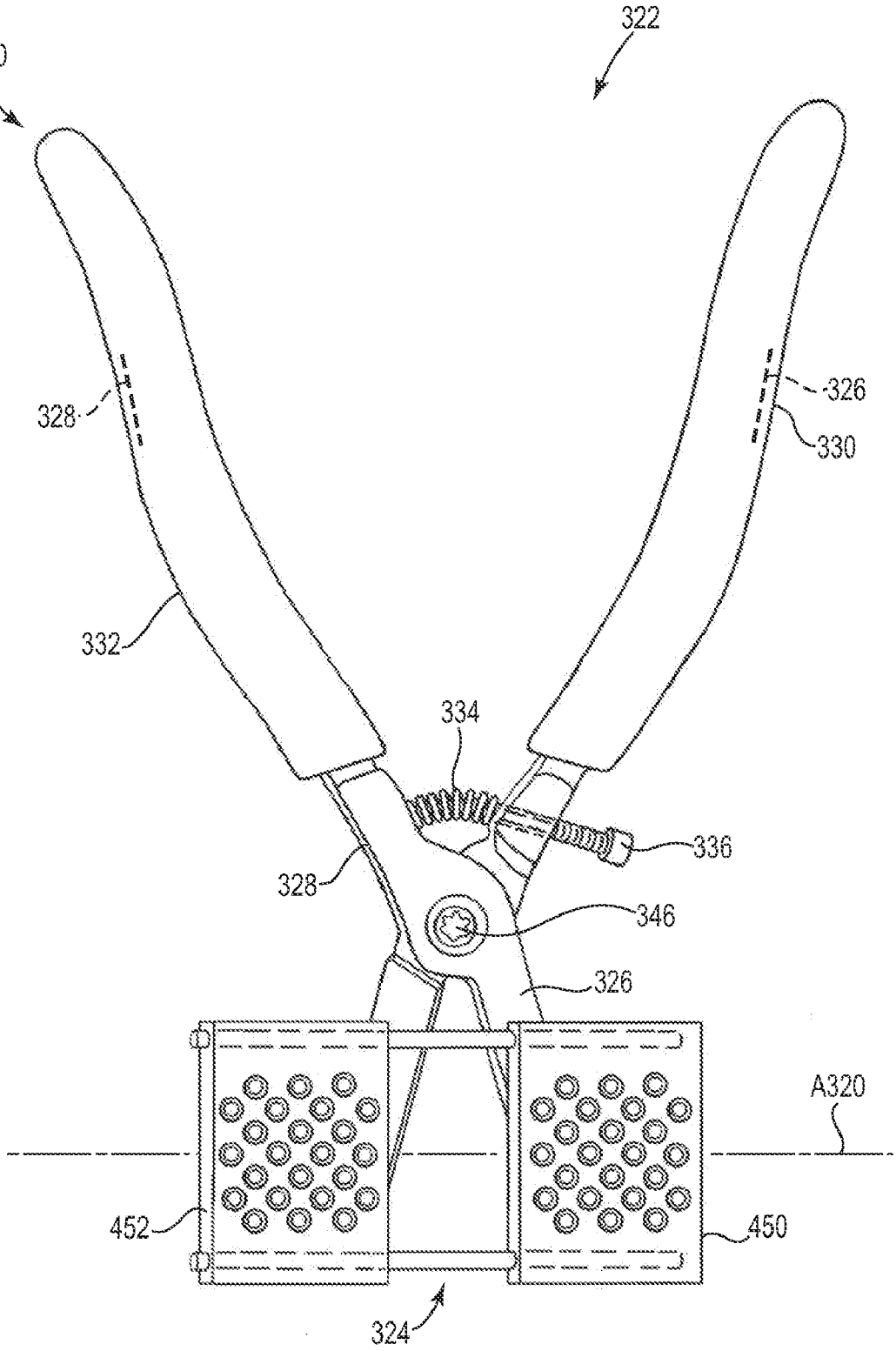
FIG. 6 is a top view of another tool, according to some embodiments.
Figure 7:
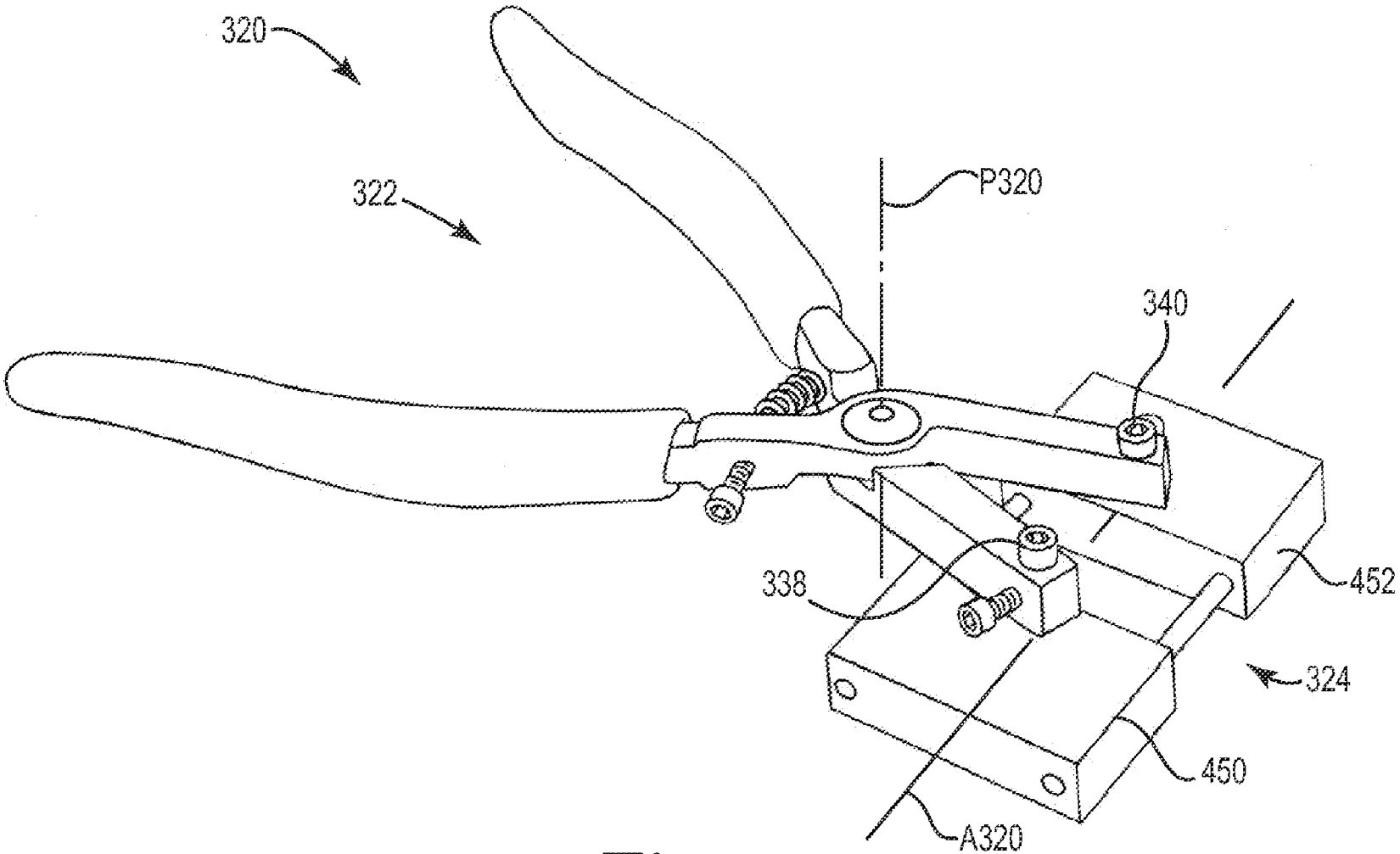
FIG. 7 is a perspective view of the tool of FIG. 6, according to some embodiments.

FIGS. 6 and 7 show another tool 320 according to some embodiments. The tool 320 includes various components that are similar to those of the tool 20, such as a proximal end 322 and a distal end 324 and is adapted to pivot about a handle pivot P320, also described as an axis of rotation P320, where the tool 320 optionally defines a substantially curved first line of action A320 at the distal end 324. In some embodiments, the tool 320 includes a first handle 326, a second handle 328, a first grip cover 330, a second grip cover 332, a biasing member 334, a limiter 336, a first retainer 338, a second retainer 340, a fastener 346, a first perforation plate 450, and a second perforation plate 452.

In some embodiments, assembly of the tool 320 generally proceeds similarly to that of the first tool 20. In comparison to the tool 20, however, the first and second handles 326, 328 of the tool 320 cross one another at the axis of rotation P320 such that upon actuating the handles 326, 328 toward one another at the proximal end 322 of the tool 320, the first and second perforation plates 450, 452 are moved toward one another along a substantially straight line of action A320. Thus, the tool 320 is optionally used to grasp objects (not shown) between the first and second perforation plates 450, 452 and/or to grasp objects between an array of forming pegs (not shown) releasably received in the perforation plates 450, 452.

Figure 8:
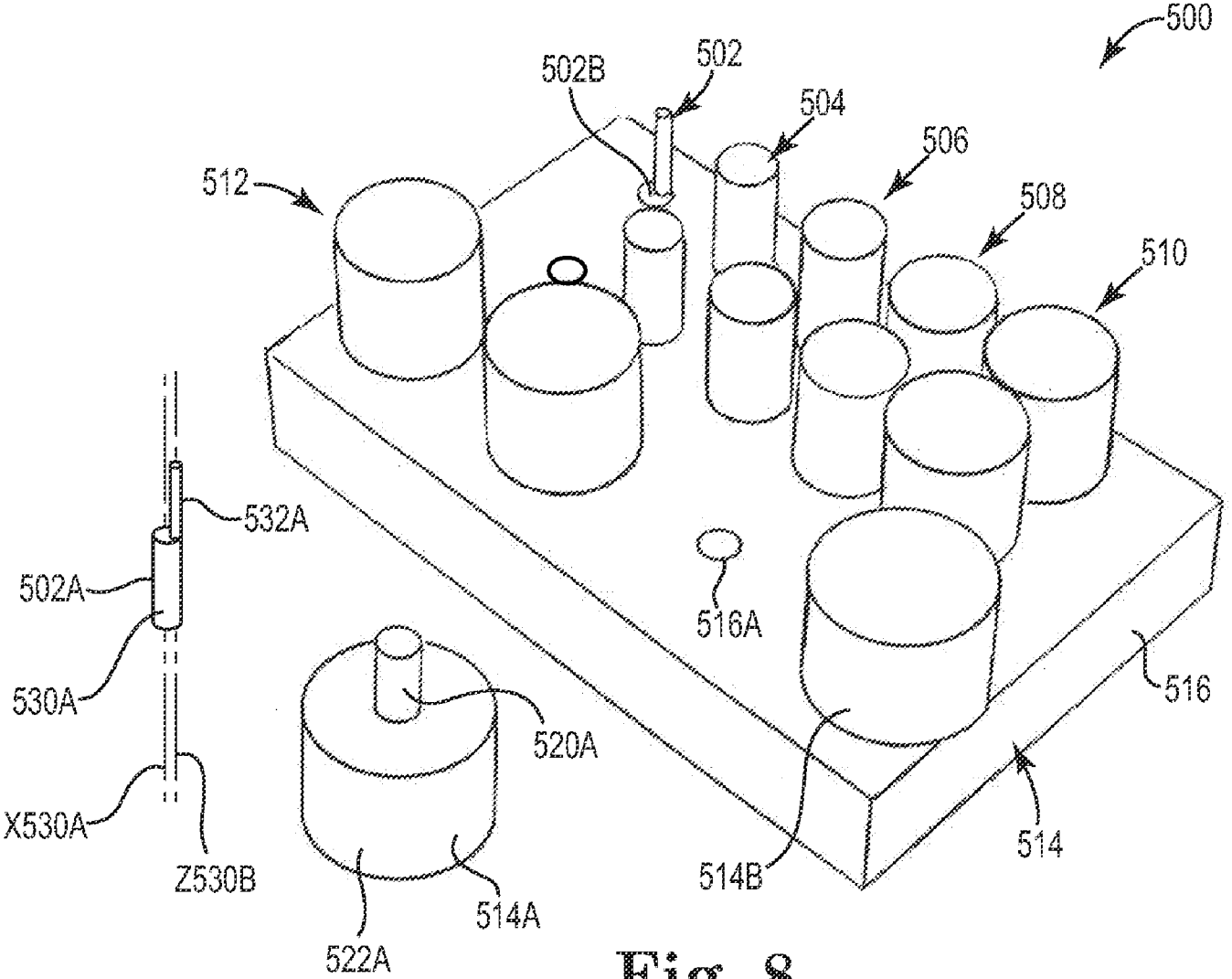
FIG. 8 is a perspective view of a set of forming peg pairs of a tool kit, according to some embodiments.

FIG. 8 shows another accessory optionally provided with the tools (e.g., in a kit of parts), such as tool 20 or tool 320. In some embodiments, the accessory includes a set of forming pegs 500 of different sizes and/or configurations. In some embodiments, the set of forming pegs 500 includes a plurality of forming peg pairs 502, 504, 506, 508, 510, 512, 514 of different sizes and an optional holder 516 having a plurality of receptacles 516A substantially similar in size and shape to the receptacles 70, 100, for example, and/or the pluralities of receptacles 174, 194 of the perforation plates 150, 152 of the first tool 20. In some embodiments, each of forming peg pairs 502-514 is adapted to be received in the receptacles 70, 100, for example, and/or the perforation plates 150, 152 of the first tool 20. The forming peg pairs 502-514 are optionally similarly receivable with the tool 320. Although the set of forming pegs 500 is shown including a pair of forming pegs for each configuration, any number and combination forming pegs is contemplated. In some gripping operations using the tool(s) 20, 320, more than two pegs of forming pegs 500 are employed (the forming pegs 500 being substantially similar or differing as desired).

The seventh forming peg pair 514 includes a first forming peg 514A and a second forming peg 514B, the forming pegs 514A, 514B optionally being substantially similar. As shown, the first forming peg 514A includes a lower portion 520A and an upper portion 522A. The lower portion 520A is configured to be received in the receptacles 70, 100 and/or the perforation plates 150, 152 while the upper portion 522A is formed to a desired shape and/or diameter (e.g., the upper portion 522A is substantially cylindrical and ½ inch in diameter in one example). In some embodiments, the upper portions of the forming peg pairs 502, 504, 506, 508, 510, 512, 514 and the first and second forming pegs 42, 44, graduate in diameter. For example, the first and second forming peg pairs optionally graduate from about 1/16 inches to about ½ inches in diameter in 1/16 inch increments. As shown, in some embodiments, the lower portions of the forming peg pairs are substantially similar in size and shape (e.g., ⅛ inch in diameter) and configured to be received in the receptacles 70, 100 and/or the perforation plates 150, 152. In some embodiments, the first pair 502 is about 1/16 inches, the first and second forming pegs 42, 44 are about ⅛ inches, the second pair 504 is about 3/16 inches, the third pair 506 is about ¼ inches, the fourth pair 508 is about 5/16 inches, the fifth pair 510 is about ⅜ inches, the sixth pair 512 is about 7/16 inches, and the seventh pair 514 is about ½ inches at the upper portions thereof, respectively. Although examples of some diameters are provided, a variety of dimensions and shapes are contemplated.

As another example, the first forming peg pair 502 includes a first forming peg 502A and a second forming peg 502B, the forming pegs 502A, 502B optionally being substantially similar. The first forming peg 502A has a lower portion 530A and an upper portion 532A. The lower portion 530A has a central longitudinal axis X530A and the upper portion has a central longitudinal axis X532A. The axes X530A, X532A are substantially parallel, but are laterally offset from one another, or eccentric to one another.

Figure 9:
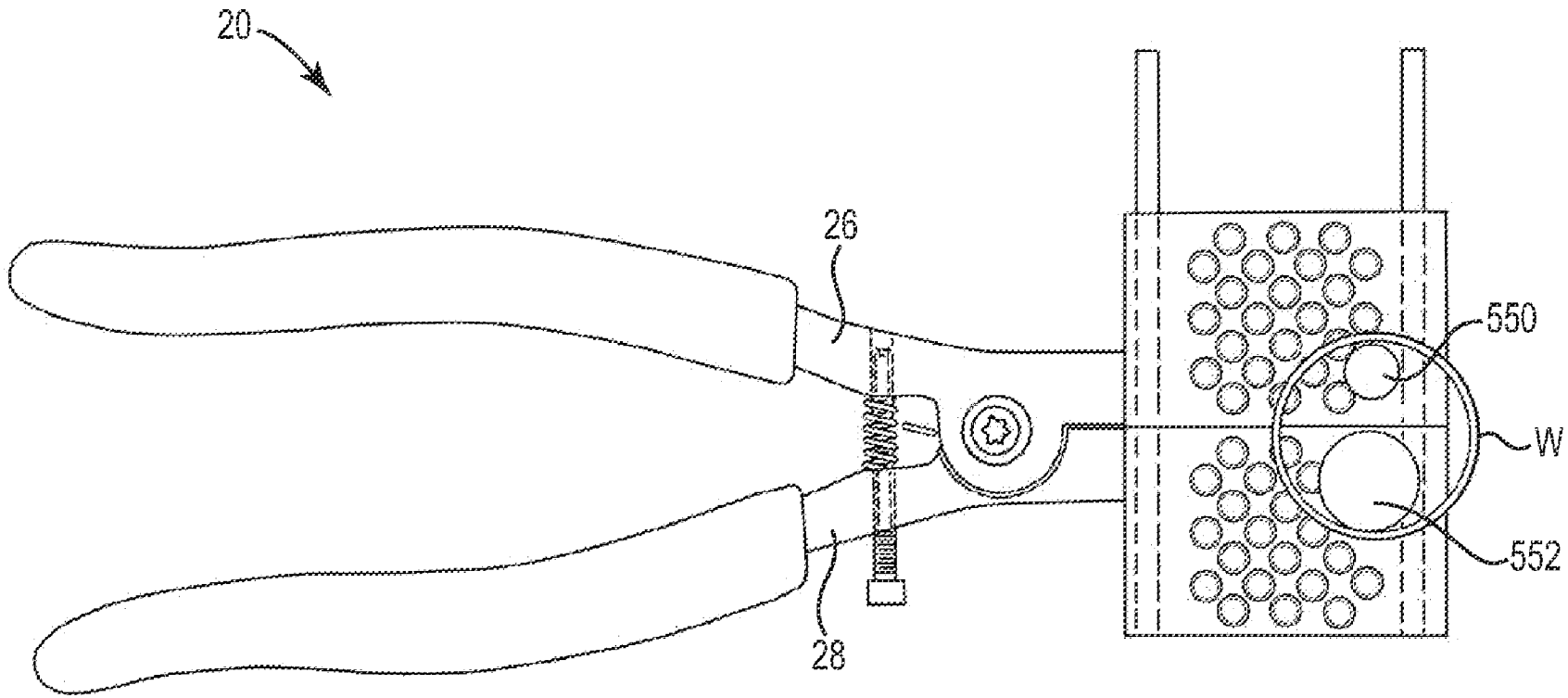
FIGS. 9 and 10 are illustrative of a method of forming a workpiece using a tool and forming pegs, according to some embodiments.
Figure 10:
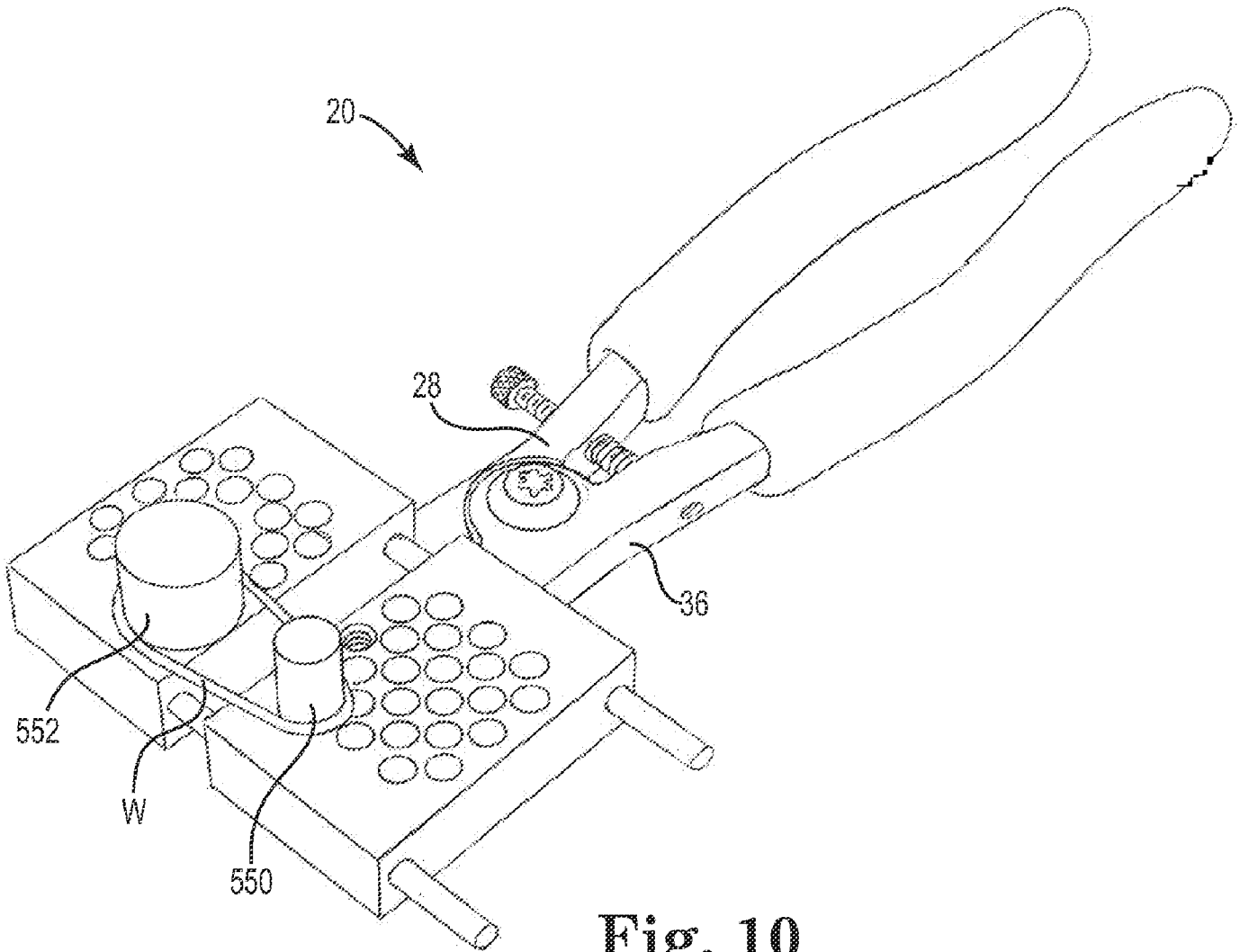

FIGS. 9 and 10 illustrate one method of forming a workpiece W (e.g., a loop of wire material) with the tool 20, where a first forming peg 550 has a first configuration and a second forming peg 552 has a second configuration, such as a larger, upper diameter than the first forming peg 550. As shown, in FIG. 9 the tool 20 is in a closed state, prior to actuation of the handles 26, 28 and FIG. 10 shows the tool 20 in an open state, following application of a forming force by actuation of the handles 26, 28 by a user (not shown).

In some embodiments, assembly of the tool 320 generally proceeds similarly to that of the first tool 20. In comparison to the tool 20, however, the first and second handles 326, 328 of the tool 320 cross one another at the axis of rotation P320 such that upon actuating the handles 326, 328 toward one another at the proximal end 322 of the tool 320, the first and second perforation plates 450, 452 are moved toward one another along a substantially straight line of action A320. Thus, the tool 320 is optionally used to grasp objects (not shown) between the first and second perforation plates 450, 452 and/or to grasp objects between an array of forming pegs (not shown) releasably received in the perforation plates 450, 452.

Figure 11:
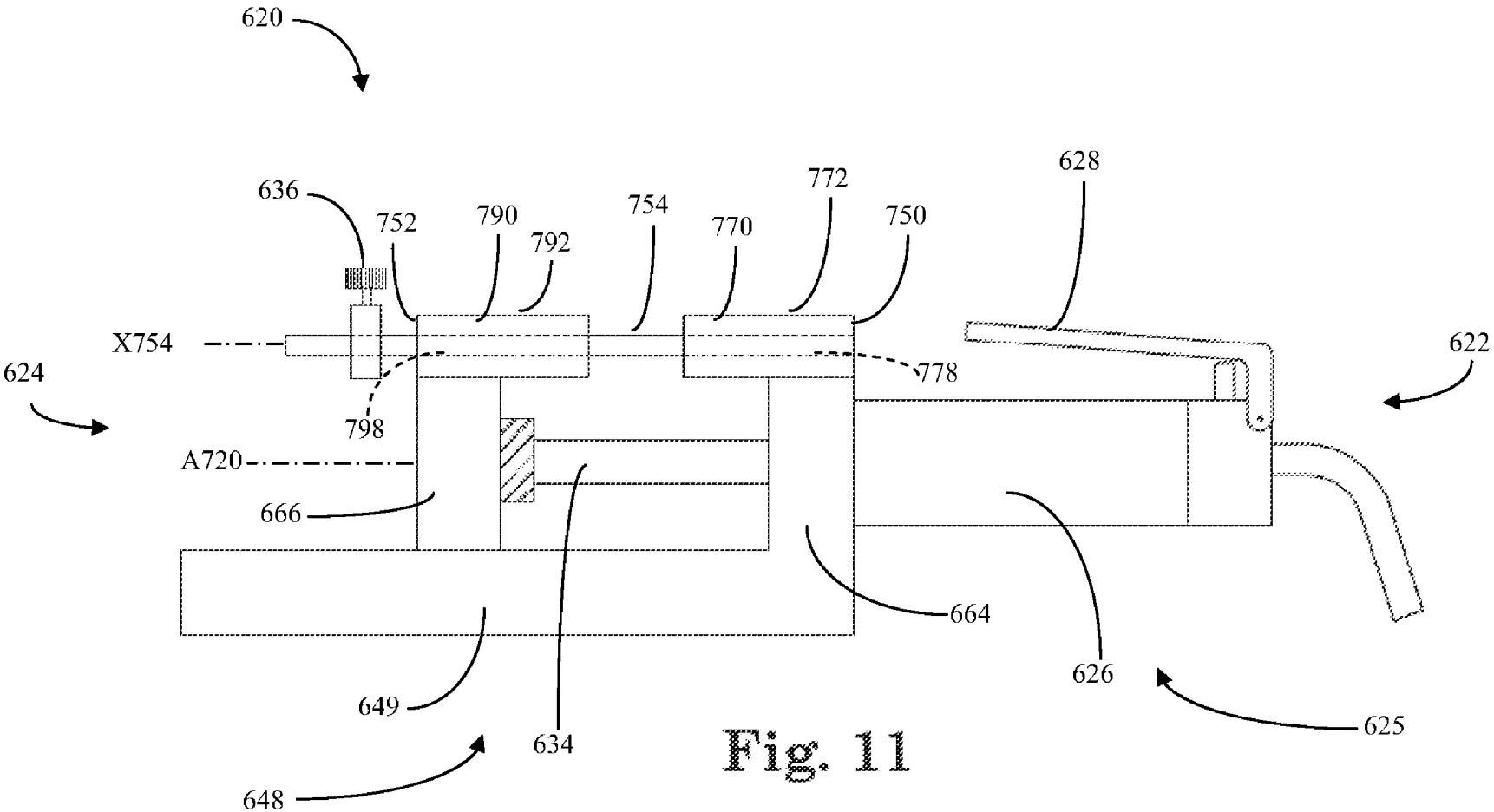
FIG. 11 is a side view of a tool in an open state, according to some embodiments.

FIG. 11 illustrates another tool 620 according to some embodiments. The tool 620 includes a proximal end 622 and a distal end 624. In some embodiments, the tool 620 includes a mounting fixture 648, the mounting fixture 648 including a base 649, a first mounting arm 664 and a second mounting arm 666. The tool 620 also includes a first perforation plate 750 attached to the first mounting arm 664, a second perforation plate 752 attached to the second mounting arm 666, a first slider 754, and actuation means 625 for applying a forming force and moving the first and second perforation plates 750, 752 in a line of action A720 that is generally parallel to a first slider 754 and in particular the central longitudinal axis X754 of the first slider 754. In some embodiments, the tool 620 also includes a limiter 636, also referred to herein as an adjustable travel stop. The tool 620 optionally includes a second slider (not shown).

The first mounting arm 664 is optionally secured, or attached, to the base 649 (e.g., via welding, screws, bolts, or other fastening means). The second mounting arm 666 is optionally slidably received against the base 649. In some embodiments, the second mounting arm 666 slides against the surface of the base 649 and moves in a substantially linear, parallel relationship with the first mounting arm 664. If desired, the second mounting arm 666 is adapted to slide on a track (not shown) secured to the base 649, or is otherwise slidably secured relative to the base 649.

The actuation means 625 is attached to the first mounting arm 664 in some embodiments, and comprises an actuator 626 (also described as an actuation portion), such as a pneumatic drive, hydraulic drive, electric motor drive, or other actuator for providing a forming force. The actuation means 625 also includes an elongate drive arm 634 (also described as a drive portion) that is attached to the second mounting arm 666. In some embodiments, the actuation means also includes an actuating lever 628 for controlling operation of the actuator 626, where depressing the actuating lever 628 extends the drive arm 634 to a maximum distance that is determined by the adjustable travel stop 636. When the actuating lever 628 is released, the drive arm 634 retracts to its beginning position. In some embodiments, the actuating lever 628 can be replaced by a foot pedal, or electric, pneumatic, hydraulic, or digitally controlled valves to regulate and control movement of the drive arm 634.

In some embodiments, the first perforation plate 750 is substantially similar to the first perforation plate 150, the first perforation plate 750 including a body 770 that is substantially block- or plate-shaped and having an upper surface 772. The body 770 has a first plurality of receptacles (not shown), also described as peg apertures, formed into the upper surface 772. The body 770 also has a first slider lumen 778 for receiving the first slider 754. In some embodiments, the body 770 has a second slider lumen (not shown) for receiving a second slider (not shown).

In some embodiments, the second perforation plate 752 is substantially similar to the second perforation plate 152, the second perforation plate 752 including a body 790 that is substantially block- or plate-shaped and has an upper surface 792. The body 790 has a second plurality of receptacles (not shown), also described as peg apertures, formed into the upper surface 792. The body 790 also has a first slider lumen 798 for receiving the first slider 754. In some embodiments, the body 790 has a second slider lumen (not shown) for receiving a second slider (not shown).

The first and second perforation plates 750, 752 are optionally used in operations similar to those described in association with the tools 20, 320. For example, pegs (not shown) are optionally inserted into the perforation plates 750, 752. The actuator 626 is optionally operated to apply a forming force that causes the first and second perforations plates 750, 752 to move away from one another along a substantially linear path in a forming (e.g., including bending and/or grasping) operation with a workpiece (not shown) received over and/or between the pegs.

The mounting arms 664, 666 help provide a means for restraining the relative lateral movement of the forming pegs. In some cases the means for restraining the relative lateral movement of the forming pegs to a first, substantially straight line of action includes the first slider 754 and, optionally, second slider. In some embodiments, the adjustable travel stop 636 also restrains the lateral movement of the forming pegs to a desired range of motion.

Figure 12:
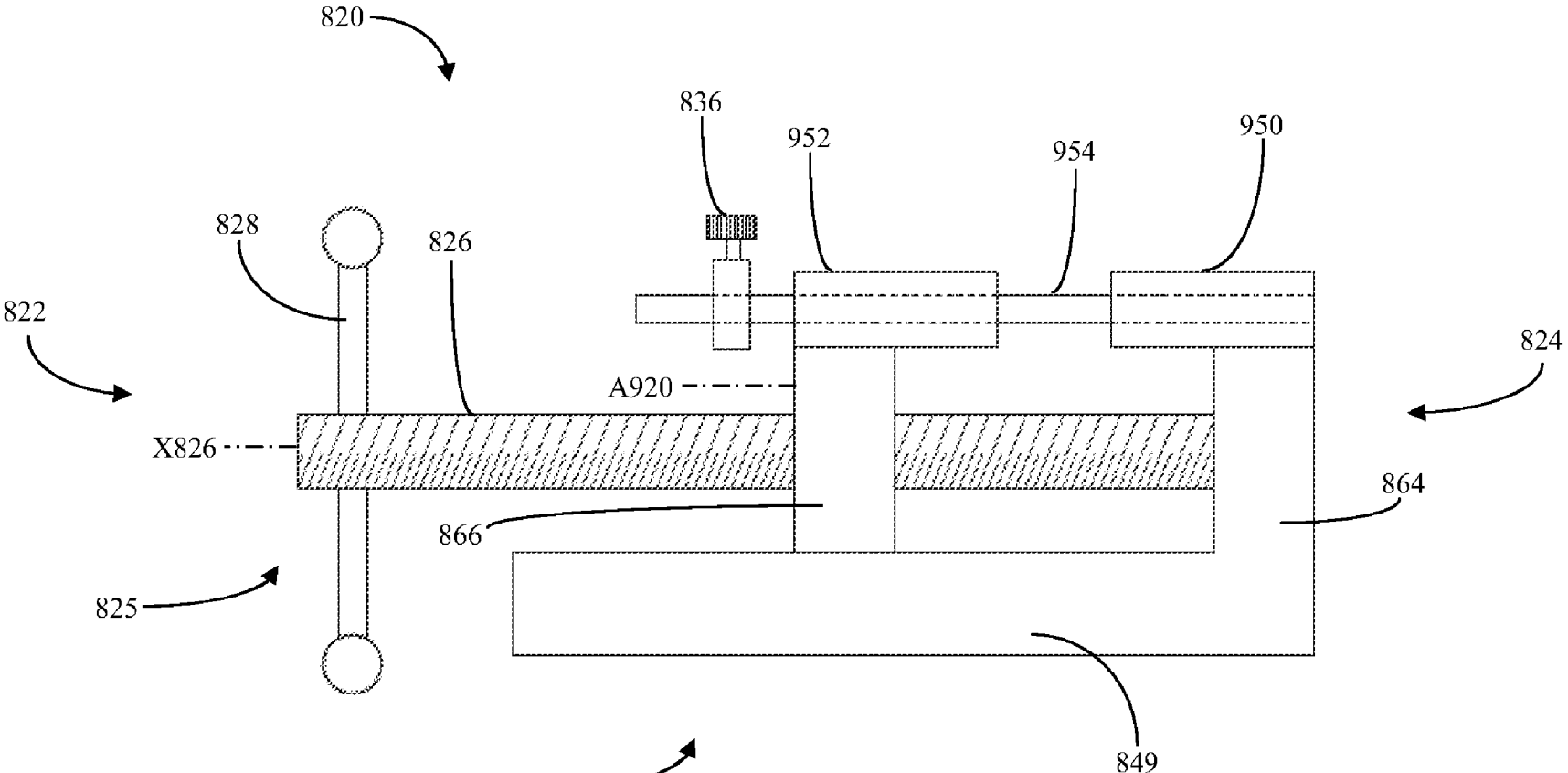
FIG. 12 is a side view of another tool in an open state, according to some embodiments.

FIG. 12 illustrates another tool 820 according to some embodiments. The tool 820 includes various components that are similar to those of the tool 620, such as a proximal end 822, a distal end 824, a mounting fixture 848 including a base 849, a first mounting arm 864 and a second mounting arm 866. The tool 820 also includes a first perforation plate 950 attached to the first mounting arm 864, a second perforation plate 952 attached to the second mounting arm 866, and a first slider 954. Tool 820 includes an actuating means 825 comprising a threaded rod 826 (also described as drive portion) for applying a forming force and moving the second mounting arm 866 along the mounting fixture 822 in a line of action A920 that is generally parallel to a first slider 954 and the central longitudinal axis X826 of the threaded rod 826. In some embodiments, the tool 820 includes an adjustable travel stop 836.

The second mounting arm 866 is threaded to accept the threaded rod 826. The threaded rod 826 is threaded through the second mounting arm 866 and affixed to the first mounting arm 864. As a forming force is applied, the threaded rod 826 is turned about axis X826, the second mounting arm 866 can move back and forth along line of action A920. The adjustable travel stop 836 determines how far the movable mount 866 moves along the mounting fixture 848.

In some embodiments, a handle crank 828 (also described as an actuation portion or actuation arm) is attached to the threaded rod 826 for application of a forming force by a user (not shown). In some embodiments, a forming force is applied to the threaded rod 826 via an actuation portion comprising an electric motor or rack and gear powered by an air cylinder or hydraulic cylinder. In some embodiments, the rotation of the threaded rod 826 can be controlled or regulated by foot pedal, electric, pneumatic, hydraulic, or digitally controlled relays and valves.

Figure 13:
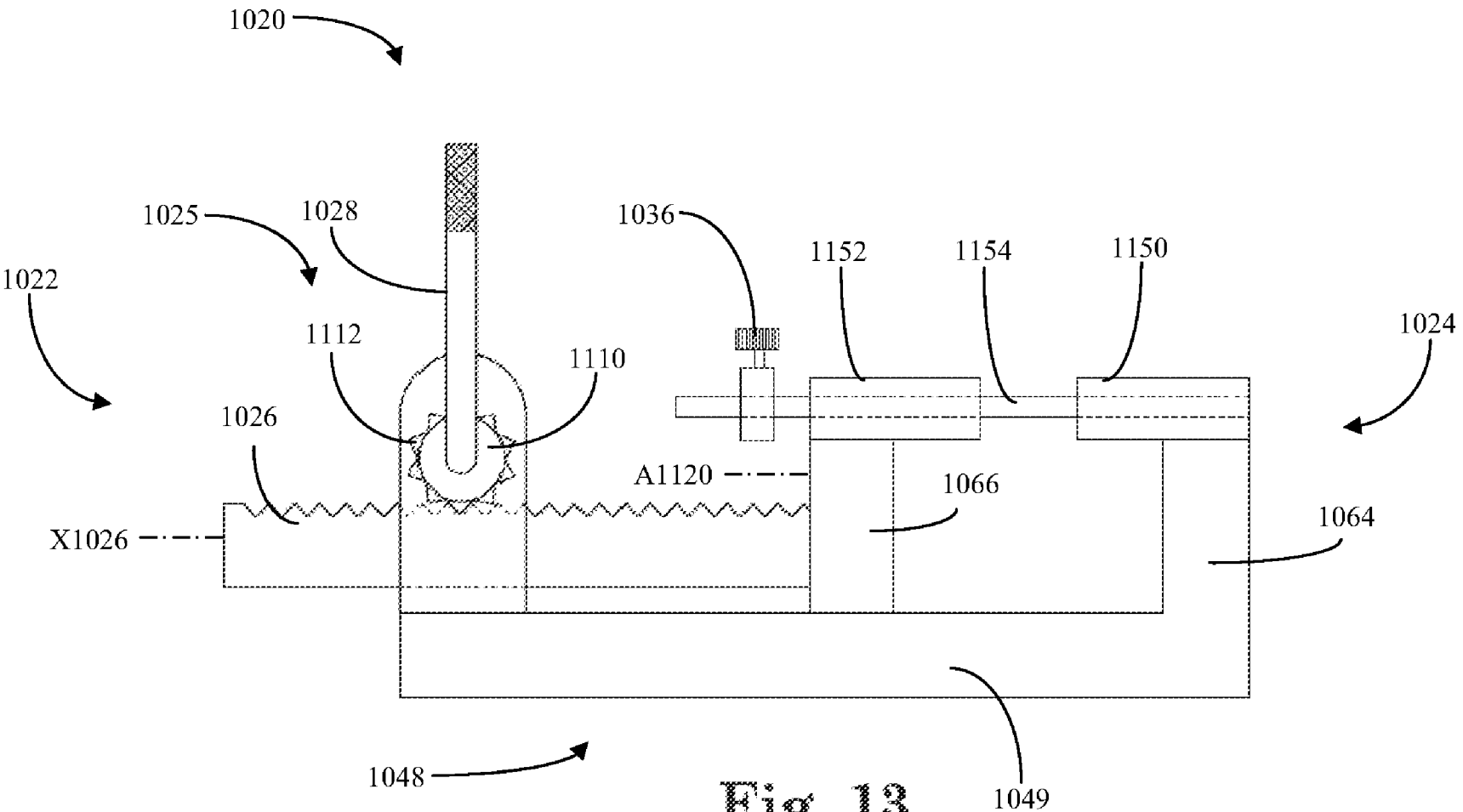
FIG. 13 is a side view of another tool in an open state, according to some embodiments.
Figure 14:
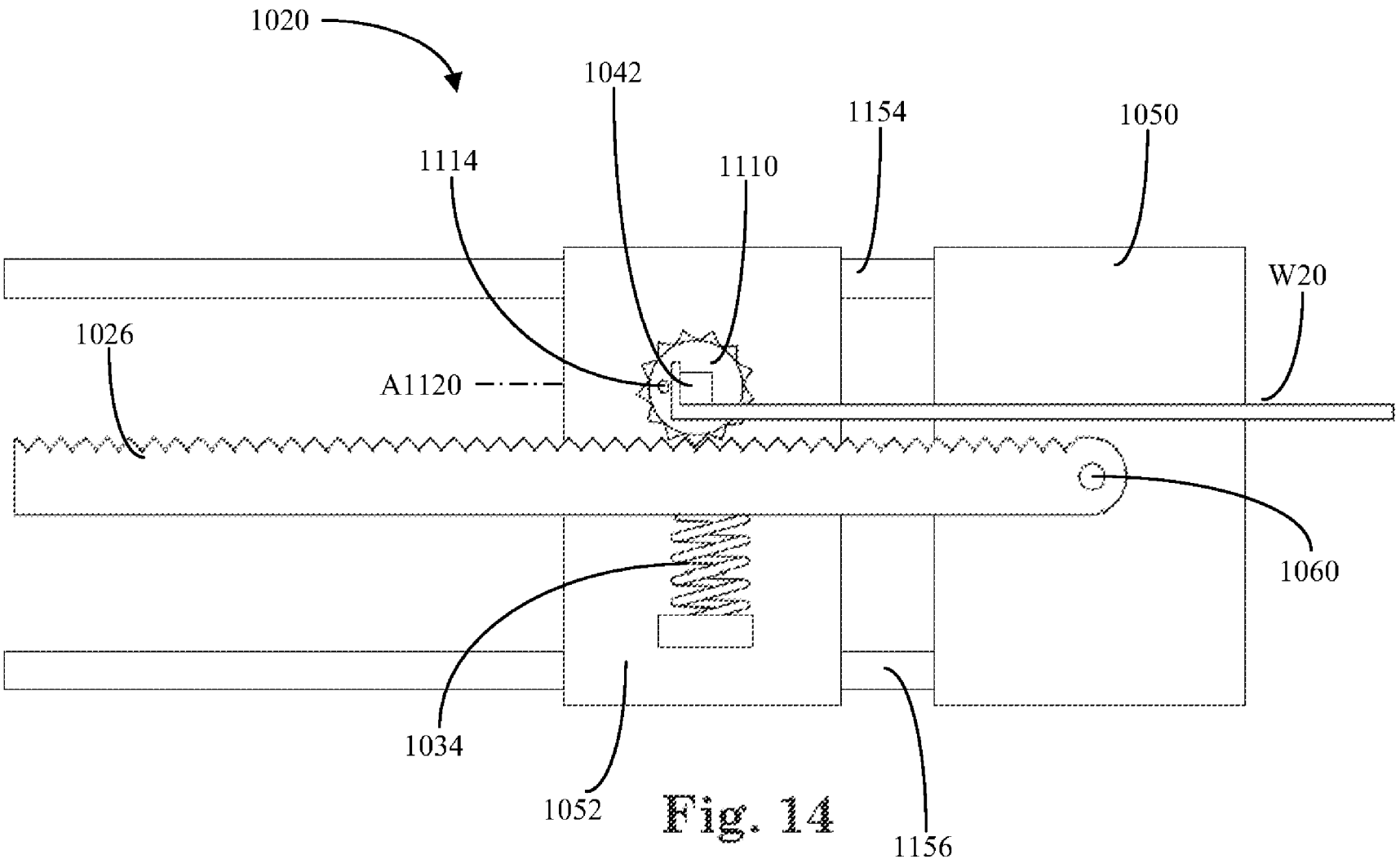
FIG. 14 is a bottom view of another tool in an open state, according to some embodiments.

FIG. 13 illustrates another tool 1020 according to some embodiments. The tool 1020 includes various components that are similar to those of the tool 620, such as a proximal end 1022, a distal end 1024, a mounting fixture 1048 including a base 1049, a first mounting arm 1064 and a second mounting arm 1066. The tool 1020 also includes a first perforation plate 1150 attached to the first mounting arm 1064, a second perforation plate 1152 attached to the second mounting arm 1066, a first slider 1154, and in some embodiments, a second slider 1156 (FIG. 14). Tool 1020 includes an actuation means 1025 comprising a rack 1026 (also described as an drive portion or drive arm) and a shaft-mounted gear 1110 (also described as an actuation portion). The rack 1026 is attached to the second mounting arm 1066 for moving the second mounting arm 1066 along the mounting fixture 1048 in a line of action A1120 that is generally parallel to a first slider 1154 and the central longitudinal axis X1026 of the rack 1026. In some embodiments, the tool 1020 includes an adjustable travel stop 1036.

The shaft-mounted gear 1110 attached to the mounting fixture 1048. In some embodiments, a lever 1028 is attached to the shaft-mounted gear 1110 such that applying a forming force to the lever 1028 rotates the gear 1110. The teeth 1112 on the gear 1110 engage the rack 1026 to move the second mounting arm 1066 back and forth along the line of action A1120. In some embodiments, the adjustable travel stop 1036 determines how far the second mounting arm 1066 moves along the mounting fixture 1048.

In some embodiments, forming force is applied to the gear 1110 via an electric motor or rack and gear (not shown) powered by an air cylinder or hydraulic cylinder. In some embodiments, the rotation of the gear 1110 can be controlled or regulated by foot pedal, electric, pneumatic, hydraulic, or digitally controlled relays and valves.

In some embodiments, a rack 1026 and gear 1110 arrangement is affixed to the perforation plates 1150, 1152. A rack 1026 is affixed to the first perforation plate 1150 and a forming gear 1110 is affixed to the second perforation plate 1152. The rack 1026 is affixed to the first perforation plate 1150 so as to be able to pivot at pivot receptacle 1060. A compression spring 1034 pushes on the rack 1026 to engage the gear 1110. As the perforation plates 1150, 1152 move back and forth in a line of action A1120, the gear 1110 rotates. The gear 1110 comprises a form 1042 designed with a geometric shape. A retention peg 1114 holds a wire W20 against the form 1042 as the gear 1110 rotates, such that the wire W20 is bent around the form 1042 to form shapes. In some embodiments, an adjustable tensioning device (not shown) is affixed to the first perforation plate 1150 to keep the wire W20 taut as it is being formed.

In some embodiments, a lever (not shown) is attached to the forming gear 1110 such that moving the lever rotates the gear 1110. In other embodiments, the forming gear 1110 incorporates a one-way bearing or ratchet mechanism (not shown) to accommodate wire forms that require multiple linear cycles to achieve the desired form.

The foregoing examples provide a description of tools, tool kits, and associated methods. The tools are suited to interchangeably maintain forming pegs or forming gears and, in some embodiments, include perforation plates and sets of forming pegs or forming gears of varying configurations, which are optionally supplied as a kit of parts to a user or other recipient. The tools provide versatile solutions to forming and/or clasping needs associated with, for example, jewelry making activities.

Although various features have been described in association with example embodiments, such features are interchangeable (e.g., as additional or alternate feature) between the various examples provided herein—while the embodiments described above refer to particular features, the scope of this invention also includes embodiments having different combinations of features and embodiments that do not include all of the described features. Similarly, various modifications and additions can be made to the exemplary embodiments discussed without departing from the scope of the present invention. Accordingly, the scope of the present invention is intended to embrace all such alternatives, modifications, and variations as fall within the scope of the claims, together with all equivalents thereof.

The following is claimed:

1. A forming tool comprising:

an actuation portion adapted to generate a forming force along a first line of action;

a drive portion secured to the actuation portion;

a mounting portion including a first mounting arm and a second mounting arm, the second mounting arm being movable relative to the first mounting arm, the second mounting arm secured to the drive portion to receive the forming force through the drive portion such that the forming force is translated along a second line of action;

a first perforation plate having at least one first peg aperture and secured to the first mounting arm;

a second perforation plate having at least one second peg aperture and secured to the second mounting arm and being secured relative to the first perforation plate such that upon the actuation portion generating a forming force the second plate moves along the second line of action;

at least one first peg releasably received in the at least one first peg aperture; and at least one second peg releasably received in the at least one second peg aperture.

2. The forming tool of claim 1, wherein the first and second lines of action are straight and parallel.

3. The forming tool of claim 1, wherein the first and second lines of action are curvilinear.

4. The forming tool of claim 1, wherein the first and second perforation plates are connected by a first slider such that the first and second perforation plates are moved parallel to one another along a straight line of action.

5. The forming tool of claim 4, wherein the first and second perforation plates are further connected by a second slider extending parallel to the first slider.

6. The forming tool of claim 4, wherein the first slider extends through the first and second perforation plates.

7. The forming tool of claim 1, wherein the actuation portion includes a pair of proximal portions of first and second handles, the drive portion includes an intermediate portion of the first and second handles forming a handle pivot between the first and second handles, and the first and second mounting legs include distal portions of the first and second handles, the handle pivot being adapted such that actuation of the pair of proximal portions of the first and second handles toward one another results in actuation of the first and second perforation plates toward one another.

8. The forming tool of claim 1, wherein the actuation portion includes a pair of proximal portions of first and second handles, the drive portion includes an intermediate portion of the first and second handles forming a handle pivot between the first and second handles, and the first and second mounting legs include distal portions of the first and second handles, the handle pivot being adapted such that actuation of the pair of proximal portions of the first and second handles toward one another results in actuation of the first and second perforation plates away from one another.

9. The forming tool of claim 1, wherein each of the first and second perforation plates has a plurality of forming pegs received in the at least one first and second peg apertures, respectively.

10. The forming tool of claim 1, wherein the first and second pegs extend parallel to one another.

11. The forming tool of claim 1, wherein the actuation portion includes a linear actuator, the drive portion includes an elongate drive arm, and the mounting portion includes a base to which the actuator and the first mounting arm are secured.

12. The forming tool of claim 11, wherein the linear actuator includes at least one of a pneumatic drive, a screw drive, a hydraulic drive, and a rack and gear drive.

13. The forming tool of claim 1, wherein the actuation portion includes a threaded rod and the mounting portion includes a base to which the first mounting arm is secured.

14. The forming tool of claim 13, wherein the drive portion includes at least one of a handle crank, an electric motor, or a rack and gear powered by an air cylinder or hydraulic cylinder.

15. The forming tool of claim 1, wherein the actuation portion includes a rack, the drive portion includes a gear, and the mounting portion includes a base to which the drive portion and the first mounting arm are secured.

16. The forming tool of claim 15, wherein the drive portion further includes at least one of an electric motor or a rack and gear powered by an air cylinder or hydraulic cylinder.

17. A forming tool comprising:

an actuation portion adapted to generate a forming force along a first line of action;

a drive portion secured to the actuation portion;

a first perforation plate secured to the drive portion to receive the forming force through the drive portion such that the forming force is translated along a second line of action;

a second perforation plate secured to the actuation portion and being secured relative to the first perforation plate such that upon the actuation portion generating a forming force the second plate moves along the second line of action;

a form designed with a geometric shape secured to the actuation portion; and a retention peg secured to the actuation portion.

18. The forming tool of claim 13, wherein the drive portion is a rack and the actuation portion is a gear.

19. The forming tool of claim 18, wherein the actuation portion includes at least one of a one-way bearing or ratchet mechanism.

* * * * *